US008721804B2

(12) United States Patent
Beshears, Jr. et al.

(10) Patent No.: US 8,721,804 B2
(45) Date of Patent: May 13, 2014

(54) DISHWASHER WITH AUXILIARY WASHING AGENT DISPENSING SYSTEM

(75) Inventors: Paul E. Beshears, Jr., Stevensville, MI (US); Jacob R. Karhoff, Swartz Creek, MI (US); Antony M. Rappette, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/279,383

(22) Filed: Oct. 24, 2011

(65) Prior Publication Data

US 2013/0098406 A1 Apr. 25, 2013

(51) Int. Cl.
*B08B 3/00* (2006.01)

(52) U.S. Cl.
USPC ..... 134/56 D; 134/57 D

(58) Field of Classification Search
USPC ..... 134/56 D
See application file for complete search history.

(56) References Cited

U.S. PATENT DOCUMENTS

| | | | |
|---|---|---|---|
| 2,127,778 | A | 8/1938 | Lewis |
| 3,612,074 | A | 10/1971 | Dossey |
| 5,235,994 | A | 8/1993 | Comin et al. |
| 6,773,668 | B1 | 8/2004 | Everson et al. |
| 7,475,696 | B2 | 1/2009 | Vanderroest et al. |
| D642,668 | S | 8/2011 | Lablaine |
| 2006/0144424 | A1 | 7/2006 | Marchitto et al. |
| 2007/0246077 | A1 | 10/2007 | Simmons et al. |
| 2008/0053494 | A1 | 3/2008 | Moro et al. |
| 2009/0178698 | A1 * | 7/2009 | Delgado ..... 134/57 D |
| 2010/0000585 | A1 | 1/2010 | Hartmann et al. |
| 2010/0012158 | A1 | 1/2010 | Rosenbauer et al. |
| 2010/0065091 | A1 | 3/2010 | Hartmann et al. |
| 2011/0030742 | A1 | 2/2011 | Dalsing et al. |

FOREIGN PATENT DOCUMENTS

| | | | |
|---|---|---|---|
| CN | 2933273 | Y | 8/2007 |
| EP | 1002494 | A1 | 5/2000 |
| EP | 1319360 | A1 | 6/2003 |
| EP | 1882439 | A1 | 1/2008 |
| EP | 0882423 | B1 | 6/2008 |
| GB | 2321590 | A | 8/1998 |
| GB | 2330522 | A | 4/1999 |
| JP | 8228989 | A | 9/1996 |
| JP | 2008005989 | A | 1/2008 |
| WO | 02/074153 | A1 | 9/2002 |
| WO | 2009083576 | A1 | 7/2009 |
| WO | 2009083577 | A1 | 7/2009 |
| WO | 2009/095638 | A1 | 8/2009 |
| WO | 2010/007050 | A1 | 1/2010 |
| WO | WO 2011/019740 | | 2/2011 |

* cited by examiner

*Primary Examiner* — Michael Barr
*Assistant Examiner* — Jason Ko

(57) ABSTRACT

A dishwasher includes an auxiliary dispenser assembly used in conjunction with an auxiliary spray unit having a plurality of spray heads arranged along a wall of a washing chamber to create an intensified wash zone in the washing chamber. The dispenser assembly includes a storage compartment for housing a washing agent, an inlet leading to the storage compartment and an outlet leading from the storage compartment. During at least one stage of a washing operation, at least a portion of the washing fluid delivered to the auxiliary spray unit is diverted and forced to flow through the storage compartment in order to pick-up additional detergent which is then delivered into the washing chamber for enhanced cleansing purposes.

26 Claims, 6 Drawing Sheets

DISHWASHER WITH AUXILIARY WASHING AGENT DISPENSING SYSTEM

BACKGROUND OF THE INVENTION

1 . Field of the Invention

The present invention pertains to the art of dishwashers and, more particularly, to the incorporation of a tough soil detergent dispensing system used in combination with a washing fluid distribution unit positioned along a wall of a dishwasher tub to timely add detergent during a washing operation.

2 . Discussion of the Related Art

Many attempts have been made in the art of dishwashers to provide improved detergent dispersion and effectiveness. One solution to the problem involves directing a cleaning agent from a dispenser directly into a spray arm. Examples of this type of dispenser are demonstrated by UK Patent Application No. GB 2321590 and U.S. Pat. No. 5,235,994. Another solution involves impinging washing fluid from a rotating spray arm directly into an exposed dispenser container to slowly dissolve and distribute a cleaning agent, as demonstrated by International Publication WO 2009/083576 . It is also known in the art to provide an auxiliary dispenser for enhancing the performance of a dishwasher as taught by U.S. Pat. No. 7,475,696.

Despite these prior designs, there is still seen to be a need in the art of dishwashers for an improved cleaning agent dispenser system for use in selectively supplementing the operation of a standard detergent dispenser in providing an optimal amount of detergent for a given washing operation. More specifically, it is seen as beneficial to provide an auxiliary dispenser that can be easily accessed by a user and selectively utilized to aide in the cleaning of heavily soiled kitchenware by quickly and effectively distributing a chemical agent within an intensified wash zone in a timed manner during a washing operation in a dishwasher.

SUMMARY OF THE INVENTION

The present invention is directed to providing a dispensing system for introducing additional chemical washing agent into the tub of a dishwasher during select portions of a washing operation. The dishwasher includes a dish rack for supporting kitchenware, at least one rotatable spray arm for directing washing fluid onto the kitchenware, an auxiliary fluid distribution or spray unit configured to create an intensified wash zone in the washing chamber during at least one stage of the washing operation, a main detergent dispenser, and an auxiliary dispenser assembly. The auxiliary dispenser assembly includes a storage compartment for housing supplemental washing agent, an inlet leading to the storage compartment and an outlet leading from the storage compartment. In accordance with one embodiment of the invention, the auxiliary dispenser assembly is attached to the dish rack for movement with the dish rack into and out of the washing chamber of the dishwasher. When the dish rack is positioned in the recessed position, the inlet of the storage compartment is automatically arranged in fluid communication with the fluid distribution unit and the outlet of the auxiliary dispenser is exposed to the washing chamber. In another embodiment, the auxiliary dispenser is provided separate from the dish rack and fixed relative to the fluid distribution unit. In either arrangement, at least a portion of the washing fluid directed to the fluid distribution unit is forced to flow through the storage compartment in order to pick up additional washing agent for enhanced cleansing purposes.

The use of the auxiliary dispenser is seen to be particularly advantageous in connection with washing kitchenware having tough soil thereon, such as soils that are baked on prior to the kitchenware being loaded into the rack, by providing a convenient way to establish a higher level of detergent concentration in the washing fluid directed onto the kitchenware during a predetermined portion of an overall washing cycle. Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
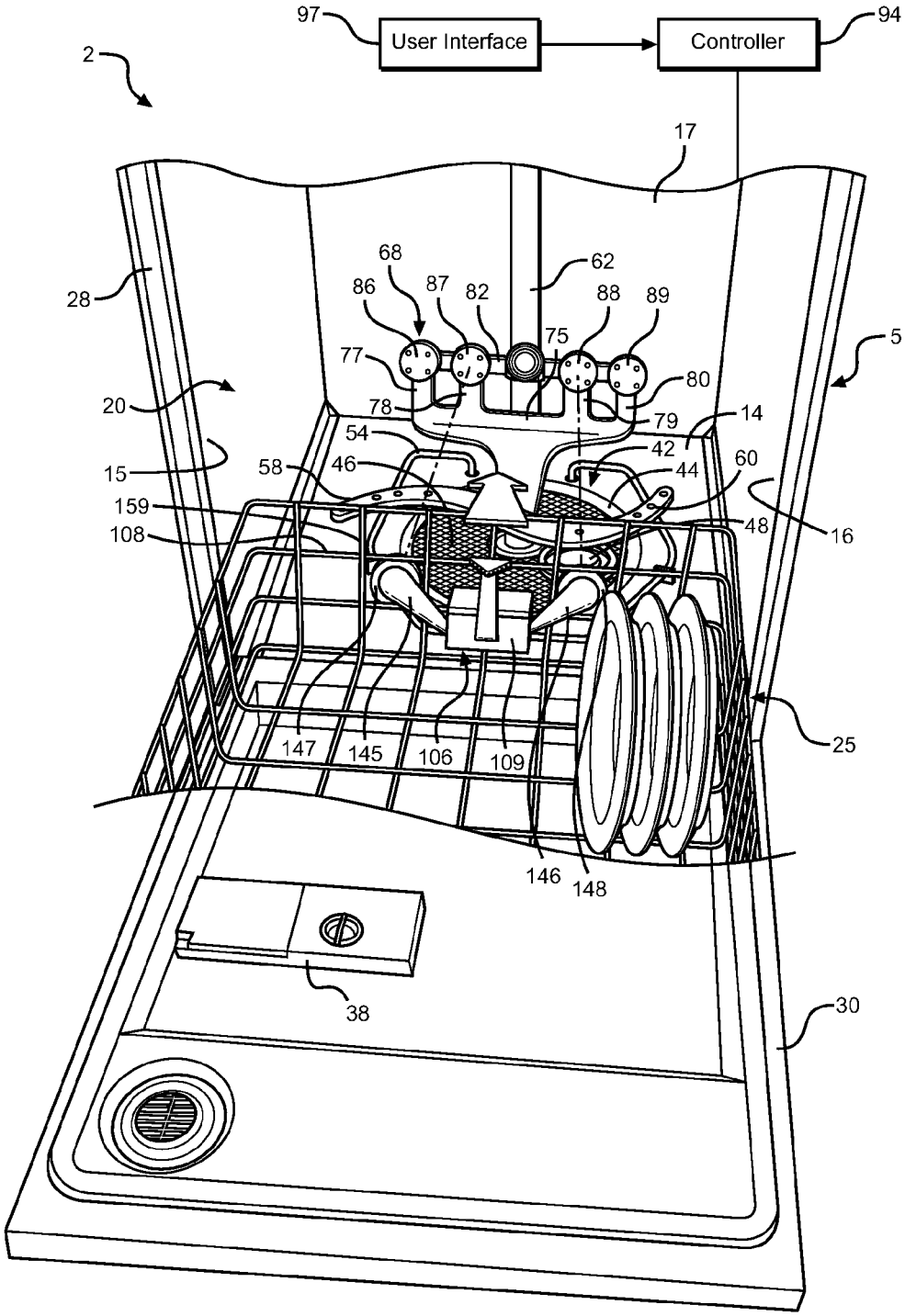
FIG. 1 is a perspective view of a dishwasher incorporating the auxiliary washing agent dispensing system of the invention.

With initial reference to FIG. 1, a dishwasher for use with the present invention is indicated at 2. As shown, dishwasher 2 includes a tub 5 which is preferably molded of plastic so as to include integral bottom, side and rear walls 14-17 respectively, as well as a top wall (not shown). At this point, it should be recognized that tub 5 could be made from various materials, including stainless steel. Within the confines of walls 14-17, tub 5 defines an interior washing chamber 20 within which soiled kitchenware is adapted to be placed, such as upon a shiftable lower rack 25 and/or an upper rack (not shown), with the kitchenware being cleaned during a washing operation. Tub 5 has attached thereto a frontal frame 28 which pivotally supports a door 30 used to seal washing chamber 20 during the washing operation. In connection with the washing operation, door 30 is preferably provided with a detergent tray unit 38 within which a consumer can place liquid or particulate washing detergent for dispensing at predetermined portions of the washing operation.

Disposed within washing chamber 20 is a pump and filtration assembly generally indicated at 42. In the preferred embodiment illustrated in this figure, pump and filtration assembly 42 includes a main housing 44, an annular, radially extending strainer 46 and a removable filter unit 48. Extending about a substantial portion of pump and filtration assembly 42, at a position raised above bottom wall 14, is a heating element 54. Heating element 54 preferably takes the form of a sheathed, electric resistance-type heating element. In a manner known in the art, pump and filtration assembly 42 is adapted to recirculate washing fluid to at least a lower wash arm 58 having spaced nozzles 60, and a conduit 62 which leads to the upper spray arm (not shown).

Figure 2:
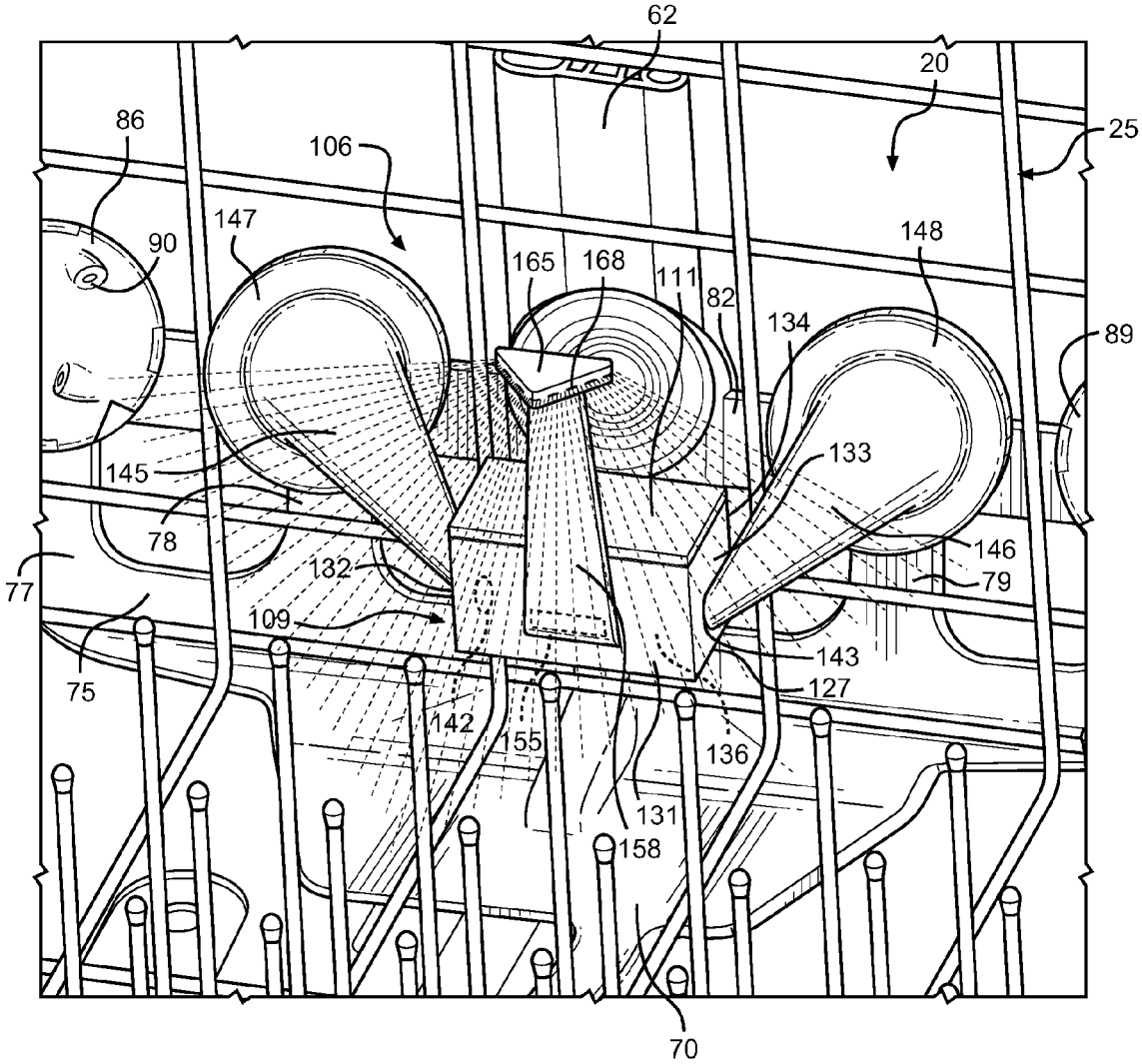
FIG. 2 is an enlarged perspective view of the auxiliary dispensing system of FIG. 1.
Figure 3:
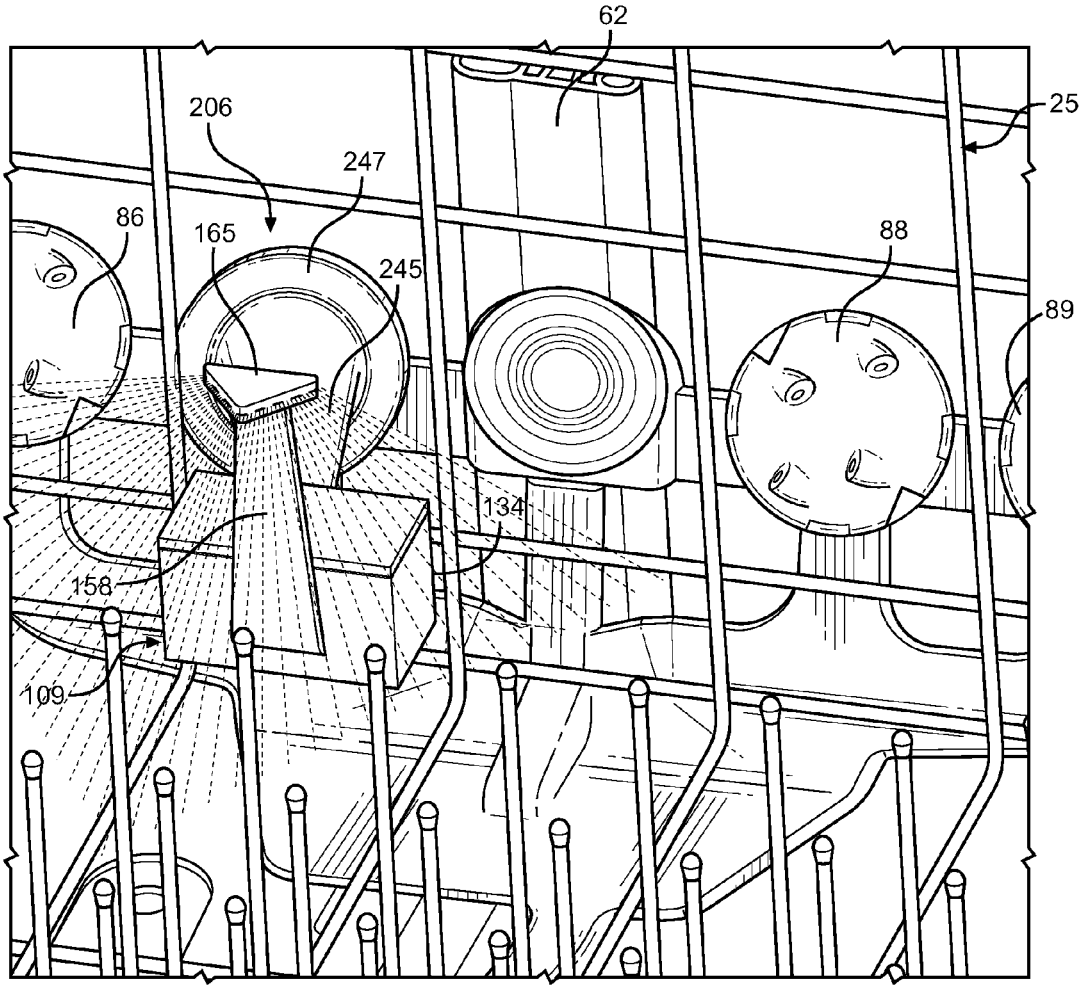
FIG. 3 is an enlarged perspective view of an auxiliary dispensing system according to a modified form of the invention.

With particular reference to FIGS. 1-3, dishwasher 2, as illustrated, is also provided with an auxiliary, fluid distribution or spray unit such as a turbo spray unit generally indicated at 68. As is known in the art, auxiliary spray or dispensing unit 68 is operable when a user selects, or the machine automatically selects, an intensified wash cycle, as opposed to a normal wash cycle, as will be discussed further below. In any case, a main inlet conduit 70 for auxiliary spray unit 68 extends from pump and filtration assembly 42 and leads to a manifold 75. Manifold 75 redistributes washing fluid received from main inlet conduit 70 to a plurality of fluid conduits defined by arms 77-80 (also see FIG. 2) that are interconnected at an upper end by a cross support 82. Each arm 77-80 is adapted to direct a flow of washing fluid from manifold 75 to a respective spray head 86-89, each having various spray nozzles such as represented at 90 in FIG. 2 for spray head 86. In accordance with the arrangement shown, nozzle heads 86-89 are adapted to rotate during operation, but could actually be fixed if desired. At this point, it should be noted that the number and location of the spray heads can be readily varied in accordance with the invention. For instance, although shown extending along rear wall 17 of tub 5, the auxiliary spray unit 68 could be arranged at either or both of side walls 15 and 16.

Also associated with dishwasher 2 is a controller generally indicated at 94 in FIG. 1, as well as a user interface 97 which is actually, preferably provided on a front surface portion (not shown) of door 30. Basically, the structure of dishwasher 2 described to this point is known in the art and does not form part of the present invention such that this description is simply provided for the sake of completeness. As also widely known in the art, dishwasher 2 is adapted to perform a washing operation with a user selecting desired operation parameters through user interface 97 and also loading liquid or particulate washing detergent in detergent tray unit 38. Upon shutting door 30 to seal washing chamber 20 and initiating the start of the washing operation, controller 94 regulates the operation of pump and filtration assembly 42 and heating element 54 in order to direct heated washing fluid upon kitchenware placed on at least rack 25. More specifically, tub 5 is partially filled with washing fluid which is circulated and filtered through operation of pump and filtration assembly 42 such that washing fluid is directed to lower wash arm 58 while also being directed through conduit 62 to the upper wash arm (not shown). During a select portion of the washing operation, dispenser unit 38 will open in order to add detergent to the washing fluid for cleansing purposes. Also, if tough stains are expected and the user selects a tough scrubbing washing operation through user interface 97, controller 94 will direct a portion of the washing fluid from pump and filtration assembly 42 into main inlet conduit 70 of auxiliary spray unit 68 during a predetermined stage of the washing operation such that the washing fluid will flow into manifold 75, arms 77-80 and out nozzle or spray heads 86-89 in order to provide a high pressure, intense washing action in at least a rear portion or intensified wash zone of rack 25.

Again, this general operation of dishwasher 2 is known in the art and the detailed description thereof is only being provided for the sake of completeness. Of particular importance in connection with the present invention is to address a desire for a higher level of detergent concentration in the washing fluid when the intense washing action is selected for dishwasher 2. More specifically, in accordance with the invention, a higher level of detergent concentration in the washing fluid is desired when auxiliary spray unit 68 is employed. To this end, in accordance with the embodiment of the invention shown in FIGS. 1 and 2, an auxiliary detergent dispenser assembly 106 is adapted to be mounted on a back portion 108 of rack 25 so as to be attached to rack 25 for movement between a recessed position within tub 5 and an extended position at least partially outside of tub 5 as shown in FIG. 1.

With particular reference to FIG. 2, the construction of dispenser assembly 106 will now be described. As shown, dispenser assembly 106 includes a cup or container 109 to which is removably attached a lid 111. Cup 109 of dispenser assembly 106 includes a base 127, a front wall 131, side walls 132 and 133, and a rear wall 134, with all of the walls 131-134 projecting upwardly from base 127. In the most preferred embodiment of the invention, cup 109 is molded of plastic so as to be integrally formed with base 127 and walls 131-134 collectively defining an internal storage compartment 136. Formed in side walls 132 and 133 are a pair of spaced openings or inlets 142 and 143 from which lead respective tapered flow conduits 145 and 146. Each flow conduit 145, 146 terminates in a respective cover or cap member 147, 148.

At this point, it should be recognized that, in accordance with this embodiment, it is desirable to provide for dispenser assembly 106 to be removably attached to rack 25. Certainly, this mounting objective can be performed in a variety of ways, such as clipping cup 109 to rack 25 in a manner directly corresponding to that disclosed in U.S. patent application Ser. No. 12/959,566 entitled "Dishwasher with Auxiliary, Tough Soil Chemistry Dispensing System" and filed on Dec. 3, 2010 . With this arrangement, the entire auxiliary dispensing assembly 106 can be readily retrofit to an existing dishwasher including auxiliary spray unit 68. In any case, it should be understood that the particular manner of attachment for dispenser assembly 106 to rack 25, as well as the lateral positioning of dispenser assembly 106, can greatly vary without departing from the invention. In addition, lid 111 could be attached to cup 109 in other ways, such as through relative pivoting or sliding movement, to selectively expose storage compartment 136.

With this overall arrangement, additional washing detergent can be readily placed within storage compartment 136 of dispenser 106 by a user, particularly when rack 25 is in the extended position of FIG. 1. That is, when rack 25 is in the extended position, lid 111 can be readily removed from cup 109 to expose storage compartment 136 for the addition of detergent, such as detergent tablets. During at least a select stage of the overall washing operation of dishwasher 2, washing fluid will be caused to flow through auxiliary spray unit 68, with a portion of this washing fluid flow being diverted by covers 147, 148 and flow conduits 145, 146 into internal storage compartment 136. In this sense, each combination of cover and flow conduit 147, 145 and 148, 146 defines a diverter member used to redirect or funnel the washing fluid to inlets 142 and 143 respectively. At this point, the washing fluid will pick up additional detergent and be forced to flow through outlet 155 and tube 158 which leads to a nozzle head 165 having openings 168. Therefore, this additional detergent laden washing fluid will be sprayed or otherwise delivered directly into tub 5. By picking up the additional detergent, this washing fluid will have an increased detergent concentration and therefore aids in creating an intensified wash zone in washing chamber 20 during at least one stage of the overall washing operation so as to provide an enhanced washing operation for tough soiled kitchenware arranged in lower rack 25.

At this point, it should be readily apparent that the objects of the invention can be carried out in various different ways. For instance, FIG. 3 illustrates a modified version of the embodiment of FIGS. 1 and 2 wherein an auxiliary detergent dispenser assembly 206 is structured identical to dispenser assembly 106 but only receives washing fluid through a single inlet (not shown) provided in rear wall 134, with the inlet being in fluid communication with a tapered conduit 245 which leads to a single cover or cap member 247. Therefore, with this arrangement, only a single one of spray heads 86-89 (shown mounted on spray head 87) is used to supply washing fluid to dispenser assembly 206, while cover 247 is generally in-line with cup 109. In all other respects, this embodiment of the invention functions in the manner directly corresponding to that described above in reference to FIGS. 1 and 2.

Figure 4:
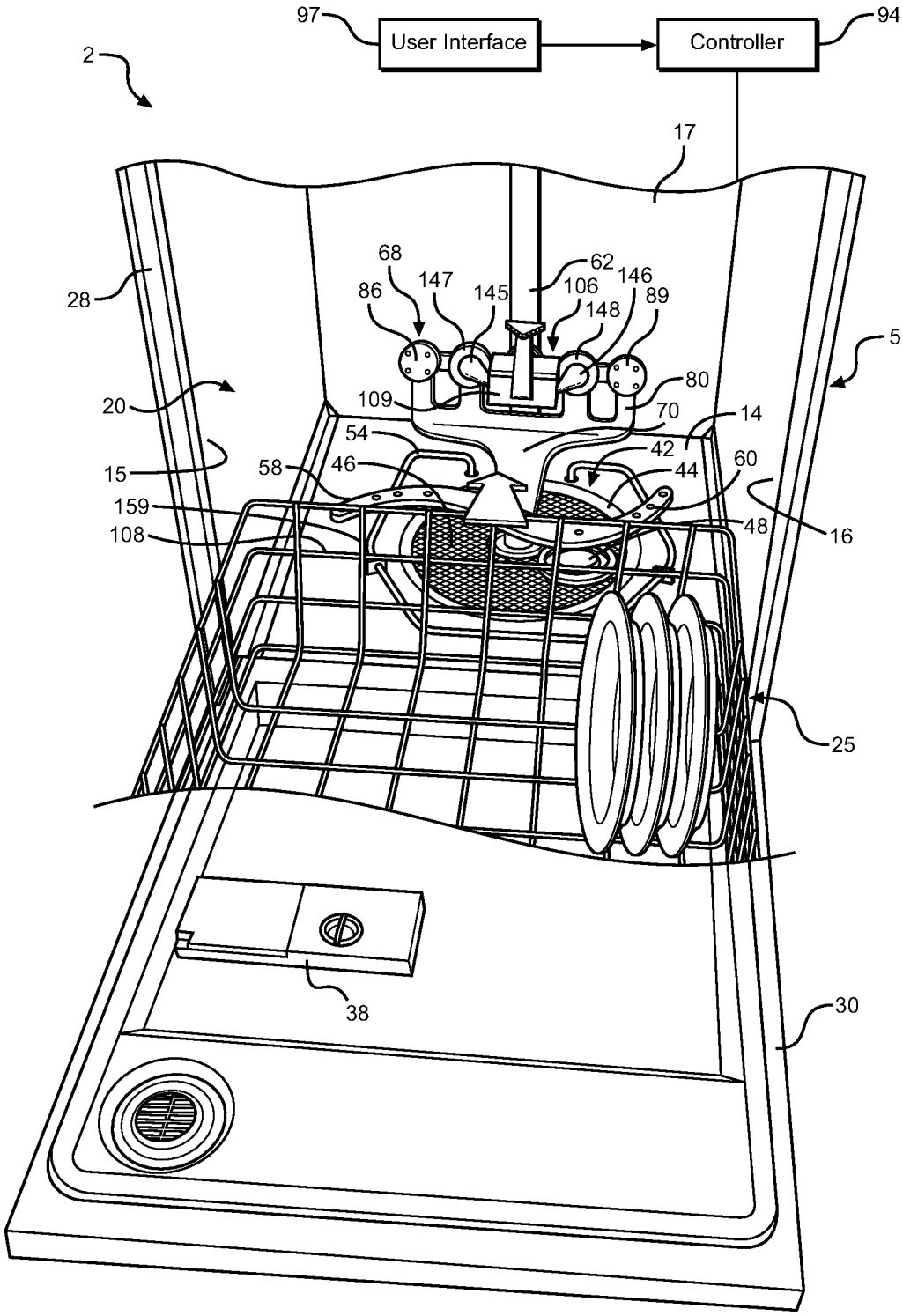
FIG. 4 is a perspective view of a dishwasher incorporating an auxiliary washing agent dispensing system according to a second embodiment of the invention.
Figure 5:
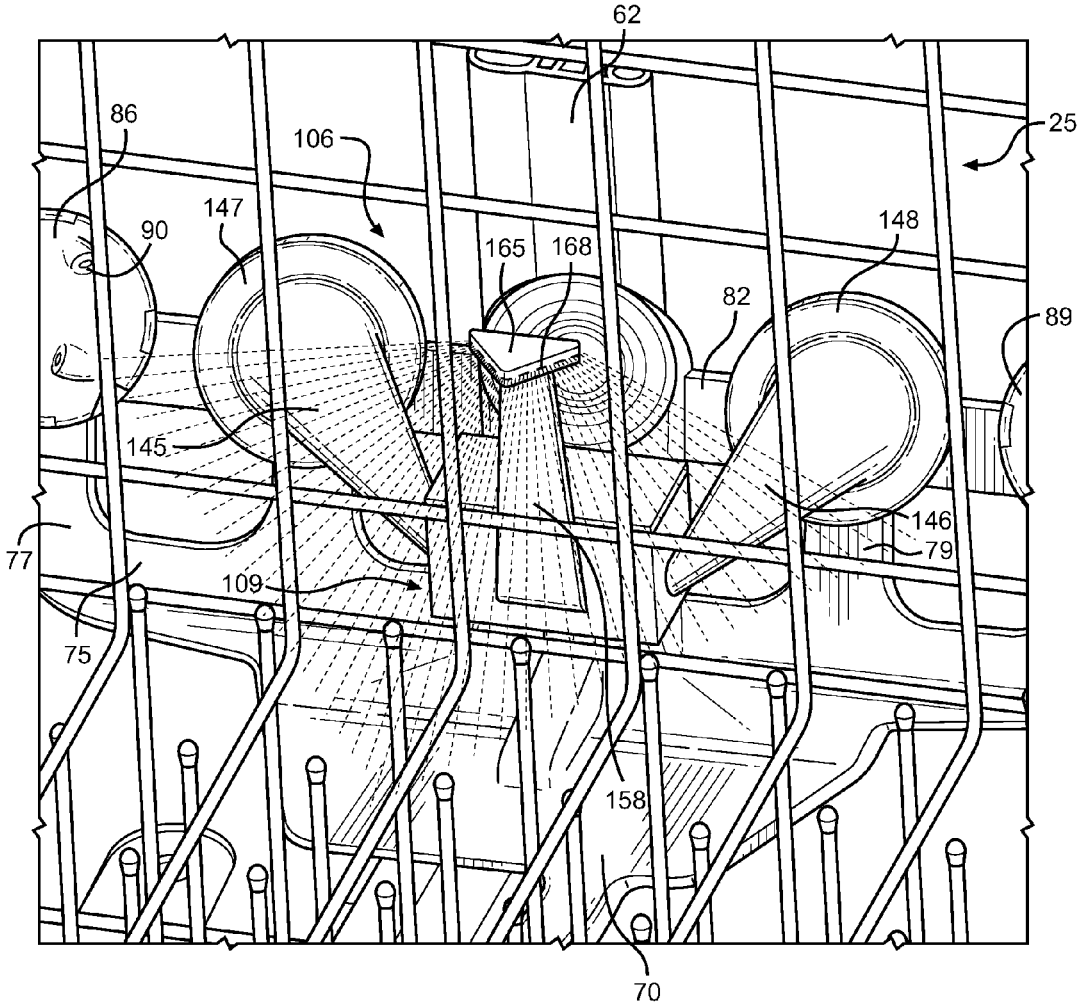
FIG. 5 is an enlarged perspective view of the auxiliary dispensing system of FIG. 4.

FIGS. 4 and 5 show a further embodiment of the invention which is substantially identical to the embodiment of FIGS. 1 and 2 as represented by the common reference numerals but wherein, instead of dispenser assembly 106 being attached to rack 25 for movement relative to tub 5, dispenser assembly 106 is fixed to auxiliary spray unit 68. Of course, a similar dispenser assembly arrangement having a single inlet and associated supply conduit such as that described with respect to FIG. 3 could equally be employed in a correspondingly fixed manner. In either case, the dispenser assembly can be fixed such as by having the one or more cover members snapped to a respective spray head and/or having the cup fixed to the manifold. As necessary, rack 25 can be shortened or reconfigured to be spaced from the dispenser assembly when in the fully retracted position.

Figure 6:
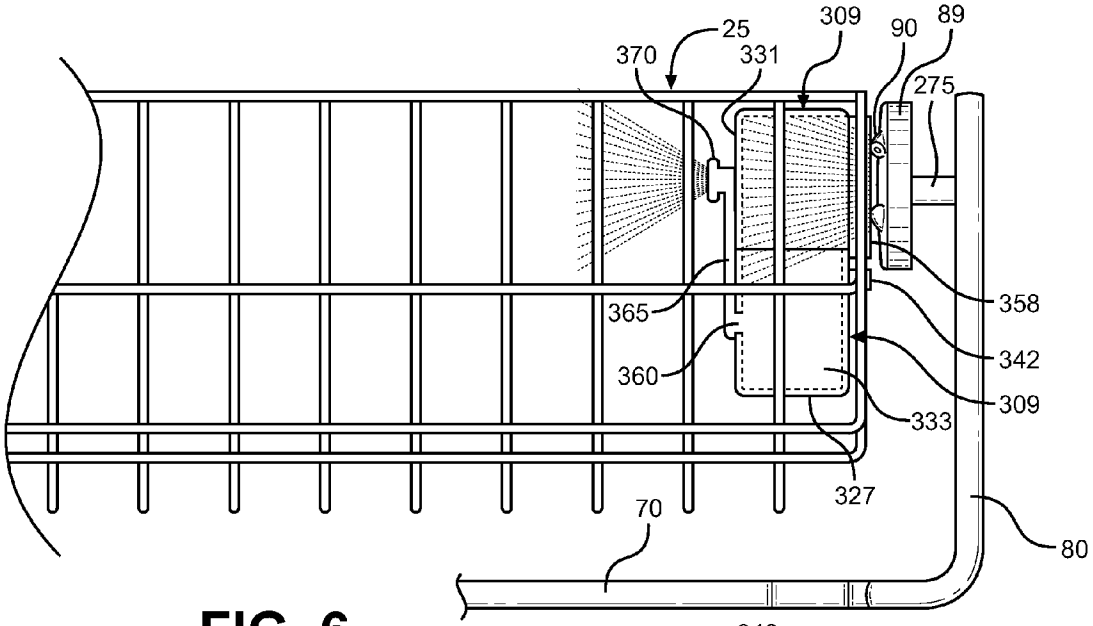
FIG. 6 is side view showing an auxiliary dispensing system in accordance with a third embodiment of the invention.
Figure 7:
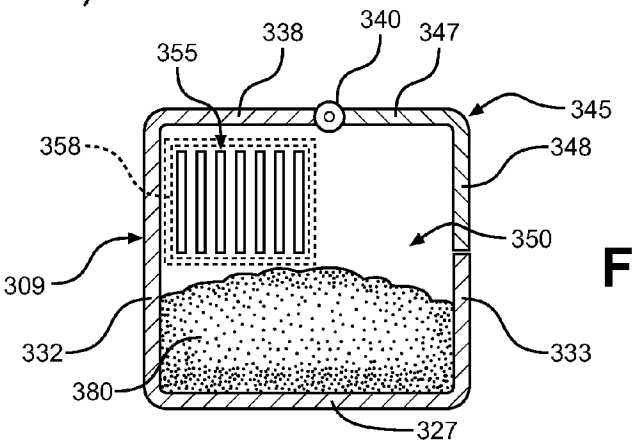
FIG. 7 is a cross-sectional view of a storage container employed in the third embodiment of FIG. 6.

By this point, it should also be readily apparent that a significant aspect of the invention concerns receiving a flow of washing fluid from the auxiliary spray unit, rather than the lower arm 58 or the upper washer arm. In fact, it should be apparent that the inlet(s) to the cup are configured to receive a generally horizontal fluid flow while being essentially blocked from receiving vertically directed flow from the lower and upper arms. That is, in accordance with the preferred embodiments, it is only desired to obtain the higher concentration of washing agent during use of the auxiliary spray unit. Along these lines, FIGS. 6 and 7 illustrate a further embodiment of the invention which shows a tube 275 linking spray head 89 to manifold 80. Arranged directly in front of spray head 89 and mounted for concurrent movement with rack 25 is a dispensing cup 309. As shown, dispensing cup 309 has a base 327, front, side and rear walls 331-334 and a top 338, which terminates at a hinge 340. Arranged along rear wall 334 are a pair of spaced clip members, one of which is indicated at 342, for snap-fittingly attaching cup 309 to rack 25. Cup 309 also includes a lid 345 having a top part 347 and a side part 348. As best shown in FIG. 7, top part 347 is pivotally mounted to top 338 through hinge 340 to provide selective access to an internal storage compartment 350. Provided along rear wall 334 is an inlet 355 leading into internal storage compartment 350. As shown, inlet 355 takes the form of a plurality of elongated, laterally spaced slots, although one or more holes of varying geometric shape could also be employed. Extending around inlet 355 are fins or flanges, such as shown at 358, which establish a diverter member for the flow from spray head 89. At this point, it should also be realized that a similar cap and conduit arrangement corresponding to the embodiments described above could also be utilized. In any case, cup 309 is also shown to include an outlet 360 which opens into an arm 365 that terminates in a nozzle or spray head 370. Lid 245 can be pivoted in order to insert a washing agent 380, such as powdered detergent, in internal storage compartment 350 and then closed. As in the other embodiments described above, when washing fluid is directed into manifold 80 and then out of spray head 89, the washing fluid will enter internal storage compartment 350 through inlet 355 housing the washing agent 380. The washing fluid, along with the washing agent, will then be directed out arm 365 through outlet 360 and delivered into washing chamber 20 through spray head 370.

Although described with reference to preferred embodiments of the invention, it should be readily understood that various changes and/or modifications can be made to the invention without departing from the spirit thereof. Instead, it should be perfectly clear that the present invention provides for an auxiliary dispenser to be either conveniently attached to a dish rack for movement with the dish rack into and out of a dishwasher tub or fixed relative to an auxiliary spray unit so as to be located in front of the auxiliary spray unit, with the dispenser including a storage compartment for housing a washing agent, an inlet leading to the storage compartment and an outlet leading from the storage compartment. With this arrangement, at least a portion of the washing fluid directed to the auxiliary spray unit will be forced to flow through the storage compartment in order to pick-up additional detergent which is then delivered, such as by spraying or otherwise, into a wash zone for enhanced cleansing purposes. In any case, in general, the invention is only intended to be limited by the scope of the following claims.

What is claimed is:

1. A dishwasher comprising:

a tub including bottom, rear and opposing side walls defining a washing chamber having a frontal opening;

a dish rack mounted for movement between a recessed position within the tub and an extended position at least partially outside of the tub, said dish rack being adapted to support kitchenware to be washed in the washing chamber;

at least one spray arm mounted for rotation within the tub for spraying washing fluid toward the dish rack during certain stages of a washing operation;

an auxiliary spray unit including a plurality of spray heads arranged at spaced locations along one of the side and rear walls of the washing chamber, said auxiliary spray unit being configured to create an intensified wash zone in the washing chamber during at least one stage of the washing operation; and a dispenser assembly including:

a storage compartment for housing a washing agent;

an inlet leading into the storage compartment;

at least one diverter member configured to extend in front of at least one of the plurality of spray heads; and an outlet leading from the storage compartment wherein, during the at least one stage of the washing operation, at least a portion of the washing fluid directed to the auxiliary spray unit is redirected by the diverter member to the inlet, through the storage compartment housing the washing agent and into the tub through the outlet.

2. The dishwasher of claim 1, wherein the at least one diverter member constitutes a cover which extends about the at least one of the plurality of spray heads to redirect the washing fluid.

3. The dishwasher of claim 2, wherein the at least one of the plurality of spray heads includes a plurality of spray nozzles, with said cover extending over each of the plurality of spray nozzles.

4. The dishwasher of claim 1, wherein the at least one diverter member includes first and second diverter members for simultaneously redirecting washing fluid to the storage compartment from multiple ones of the plurality of spray heads.

5. The dishwasher of claim 4, wherein the dispenser assembly further includes first and second conduits leading from the first and second diverter members into the storage compartment.

6. The dishwasher of claim 1, wherein the dispenser assembly is fixed relative to the at least one of the plurality of spray heads, even when the rack is in the extended position.

7. The dishwasher of claim 1, wherein the dispenser assembly is mounted to the rack for concurrent movement between the recessed and extended positions.

8. The dishwasher of claim 1, wherein the outlet of the dispenser assembly is in fluid communication with a spray head exposed directly to the washing chamber.

9. The dishwasher of claim 8, further comprising: a tube leading from the outlet of the storage compartment to the spray head.

10. The dishwasher of claim 9, wherein the tube extends substantially vertically within the tub.

11. The dishwasher of claim 1, further comprising:

a door mounted for movement between an open position for accessing the washing chamber and a closed position sealing the washing chamber for the washing operation; and a primary washing agent dispenser provided on the door.

12. A dishwasher comprising:

a tub defining a washing chamber having a frontal opening;

a dish rack mounted for movement between a recessed position within the tub and an extended position at least partially outside of the tub, said dish rack being adapted to support kitchenware to be washed in the washing chamber;

at least one spray arm mounted for rotation within the tub for spraying washing fluid toward the dish rack during certain stages of a washing operation;

an auxiliary spray unit extending along a wall at a rear portion of the washing chamber and being configured to create an intensified wash zone in the washing chamber during at least one stage of the washing operation; and a dispenser assembly including:

a storage compartment for housing a washing agent;

an inlet leading into the storage compartment; and an outlet leading from the storage compartment wherein, during the at least one stage of the washing operation, said inlet is located in front of a portion of the auxiliary spray unit at the rear portion of the washing chamber and at least a portion of the washing fluid directed to the auxiliary spray unit is directed into the inlet, through the storage compartment housing the washing agent and into the tub through the outlet.

13. The dishwasher of claim 12, further comprising: at least one diverter member configured to extend in front of the portion of the auxiliary spray unit to only permit a substantially horizontal flow of washing fluid to the inlet.

14. The dishwasher of claim 13, wherein the auxiliary spray unit includes a plurality of spray heads arranged at spaced locations along the one of the side and rear walls, and the at least one diverter member constitutes a cover which extends about at least one of the plurality of spray heads of the auxiliary spray unit.

15. The dishwasher of claim 14, wherein the at least one diverter member includes first and second diverter members for simultaneously redirecting washing fluid to the storage compartment from multiple ones of the plurality of spray heads.

16. The dishwasher of claim 15, wherein the dispenser assembly further includes first and second tapered conduits leading from the first and second diverter members into the storage compartment.

17. The dishwasher of claim 12, wherein the dispenser assembly is fixed relative to the auxiliary spray unit, even when the rack is in the extended position.

18. The dishwasher of claim 12, wherein the dispenser assembly is mounted to the rack for concurrent movement between the recessed and extended positions.

19. A method of operating a dishwasher including a tub including bottom, rear and opposing side walls defining a washing chamber having a frontal opening, a dish rack for supporting kitchenware to be washed in the washing chamber with the dish rack being movable between an extended, loading position and recessed, operational position, at least one spray arm mounted for rotation within the washing chamber for spraying washing fluid toward the dish rack during certain stages of a washing operation, and an auxiliary spray unit including a plurality of spray heads arranged along one of the side and rear walls of the washing chamber and configured to create an intensified wash zone in the washing chamber during at least one stage of the washing operation, said method comprising: operating the dishwasher in one stage of the washing operation during which washing fluid is directed into the washing chamber through the at least one spray arm but not the auxiliary spray unit; operating the dishwasher in another stage of the washing operation during which i) washing fluid is directed to and sprayed from the auxiliary spray unit and ii) at least a portion of the washing fluid sprayed from the auxiliary spray unit is: a) directed to an inlet of a storage compartment housing a washing agent by a diverter member configured to extend in front of the at least one of the plurality of spray heads, b) forced to flow through the storage compartment wherein the washing fluid picks up washing agent, and c) is directed to an outlet of the storage compartment and onto kitchenware on the dish rack.

20. The method of claim 19, further comprising: covering at least a portion of the auxiliary spray unit with a diverter member to direct the portion of the washing fluid sprayed from the auxiliary spray unit to the inlet of the storage compartment.

21. The method of claim 20, wherein the diverter member only permits a substantially horizontal flow of washing fluid to enter the inlet.

22. The method of claim 19, further comprising: simultaneously redirecting washing fluid from multiple ones of the plurality of spray heads to the storage compartment through first and second diverter members.

23. The method of claim 22, further comprising: directing the washing fluid from the multiple ones of the plurality of spray heads into the storage compartment through first and second covers positioned over the multiple ones of the plurality of spray heads and first and second tapered conduits of the first and second diverter members.

24. The method of claim 19, further comprising: automatically placing the inlet of the storage compartment in fluid communication with the auxiliary spray unit upon retracting the dish rack into the recessed, operational position.

25. The method of claim 24, further comprising: selectively detaching the storage compartment from the rack.

26. The method of claim 19, further comprising: maintaining the inlet of the storage compartment in fluid communication with the auxiliary spray unit upon moving the dish rack to the extended, loading position.

* * * * *